United States Patent [19]

Woodard

[11] 4,225,437

[45] Sep. 30, 1980

[54] POOL SKIM NET WITH ROCK SCOOP

[76] Inventor: Randle C. Woodard, 20751 Prairie St., Chatsworth, Calif. 91311

[21] Appl. No.: 34,297

[22] Filed: Apr. 30, 1979

[51] Int. Cl.[2] ..... B01D 33/00

[52] U.S. Cl. ..... 210/223; 210/407; 210/470; 15/1.7

[58] Field of Search ..... 210/222, 223, 407, 169, 210/470, 456; 15/1.7

[56] References Cited

U.S. PATENT DOCUMENTS

| | | | |
|---|---|---|---|
| 1,987,011 | 1/1935 | Kahn | 210/470 |
| 2,873,027 | 2/1959 | Dohner | 210/222 |
| 3,368,686 | 2/1968 | Petrik | 210/407 |
| 4,152,801 | 5/1979 | Lieber | 210/456 X |

*Primary Examiner*—John Adee

*Attorney, Agent, or Firm*—Matthew P. Lynch

[57] ABSTRACT

Provided is a skim net for use in swimming pools, comprising a frame and an open, meshed netting stretched in the frame. Rearwardly of the frame is a handle attachment of the quick connect and disconnect-type. The forward sweep end of the net frame is of substantial flat configuration in relation to the height of the sides and base of the frame, forming a shovel-shaped frame end which serves as a scoop for the removal of rocks, debris, and like substances, of the swimming pool surface. Additionally, the frame forward end is provided with a recessed magnet to attract metallic objects as, for example, hair pins.

10 Claims, 5 Drawing Figures

FIG. 1
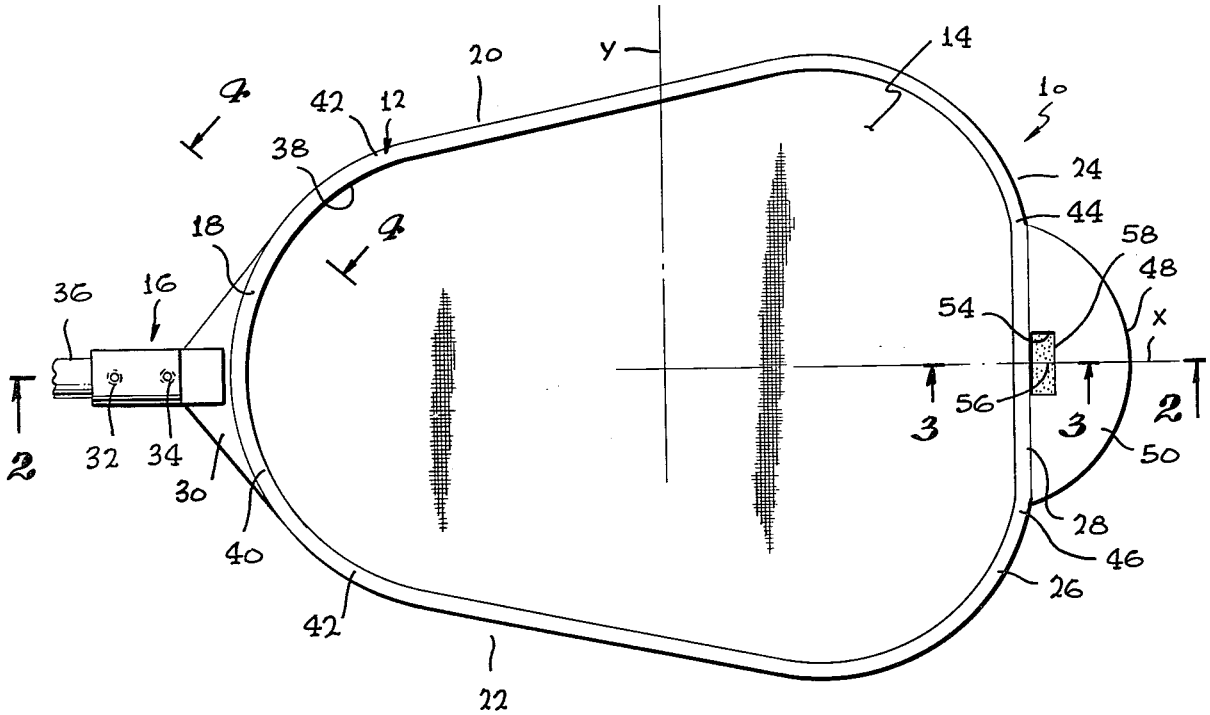
FIG. 2
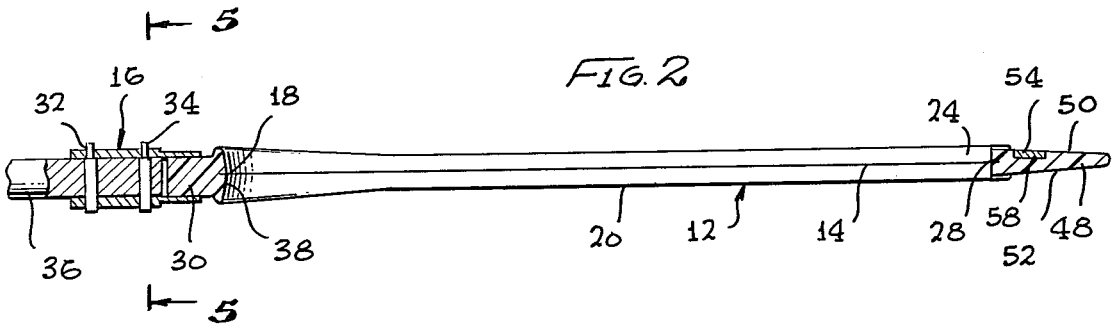
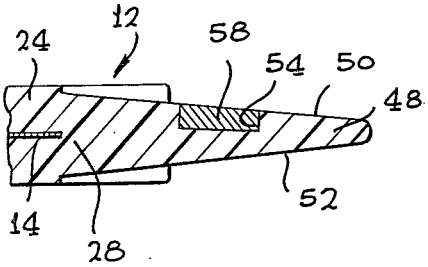
FIG. 3
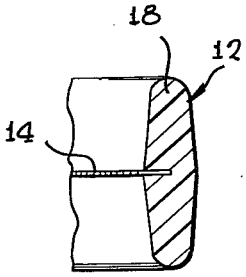
FIG. 4
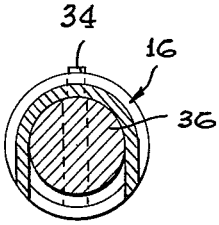
FIG. 5

POOL SKIM NET WITH ROCK SCOOP

BACKGROUND OF THE INVENTION

1. Field of the Invention

The present invention generally relates to swimming pool cleaning equipment and, more in particular, relates to a pool skim net formed with a rock scoop and a magnet, the latter serving to attract metallic objects off the pool surface and onto to the net.

2. The Prior Art

Widely known and used in the application of cleaning swimming pools, are the so-called skim nets or "leaf skimmers" adapted to be manually moved over and along the water surface of a pool to remove undesired, unhygenic and water-fouling floating material. Typically, these skim nets are light in construction and are easy to maneuver and include a frame usually of a more or less oval geometry, and a meshed netting stretched in the frame. Although these skim nets are most satisfactory for skimming purposes, they are, on the whole, unsuitable for the removal of non-floating objects as, for instance, rocks, hair pins, and the like, from the swimming pool surface or bottom.

SUMMARY OF THE INVENTION

Accordingly, the object of the invention is to provide a pool skim net having novel structure to enable easy removal of hard solid matter, e.g., rocks, stones, and the like, from the florr or bottom of a swimming pool.

A further object of the invention is to provide a pool skim net with means to attract and take up metallic objects from the floor of a swimming pool.

A still further object of the invention is to provide such a novel pool skim net which is economical to manufacture, simple in its construction, and easy to operate.

According to the invention such a novel pool skim net is made of a light-weight plastic material and comprises a frame, a netting stretched in the frame, and a handle attachment of metal or plastic secured to the rearward end of the frame. The frame forward end has a substantially flat, rounded configuration resembling the scoop end of a shovel and thus configured to enable to scoop-up solid matter off the pool floor and deposit same onto the netted area. In addition, the upper surface of the shovel end is provided with a recessed magnet operative to attract metallic objects from the pool floor.

These togeth with other objects and advantages which will become subsequently apparent reside in the details of construction and operation as more fully hereinafter described and claimed, references being had to the accompanying drawings, in which:

BRIEF DESCRIPTION OF THE DRAWINGS

FIG. 1 is a perspective view of a skim net for swimming pools, according to the invention;

FIG. 2 is a longitudinal cross-section view taken on the line 2—2 of FIG. 1;

FIG. 3 is a transverse sectional view taken through the net forward end and through a plane indicated by section line 3—3 in FIG. 1;

FIG. 4 is a transverse sectional view taken on the line 4—4 of FIG. 1; and

FIG. 5 is a cross-sectional view taken on the line 5—5 of FIG. 1.

DESCRIPTION OF THE PREFERRED EMBODIMENT

Referring now to the drawings in which like reference numerals index like parts and with attention initially directed to FIG. 1, there is shown a skim net, referenced generally by the numeral 10, incorporating novel structure in accordance with the invention.

The net 10, typically is made of a suitable plastic material and of a light-weight construction. Net 10 is seen to comprise a frame 12, a mesh netting 14 stretched in frame 12, and a handle-attachment 16 secured to the frame rearward end 18 in the plane X of the frame, the plane X representing the longitudinal axis of the frame. The handle may be made of any suitable hard plastic material or a metallic.

Net frame 12 is of substantially elliptical configuration and includes planar side portions 20, 22, arcuately-shaped front portions 24, 26 intermediate planar portions 20, 22 and the frame forward end 28. The latter end extends in a plane parallel with the transverse axis Y of net 10.

Rearward end 18 of frame 12 is part-circular and extending radially outwardly therefrom is an extension 30 formed integrally with the exterior surface of frame rearward end 18. Bonded or secured in any other suitable manner to extention 30 of frame rearward end 18, is the handle attachment 16. Handle attachment 16, as shown clearly in FIG. 2, has incorporated therein two quick connect-and disconnect elements 32, 34, the latter being of the push-button type of conventional construction. A handle 36 is shown as being detachably positioned within handle-attachment 16.

Netting 14 may be securred to the inner surface 38 of frame 12 in any suitable manner as, for instance, by injection molding. In the arrangement shown in FIG. 4, netting 14 is injected into frame, the latter having a substantially oval cross-sectional configuration.

Frame sections 18, 20, 22 and 24, 26 have the oval cross-sectional configuration as that shown in FIG. 4. Arcuate sections 24, 26 terminate, at the forward end of the frame into substantially square-shaped forward end 28, FIGS. 2 and 3.

Forward end 28, at the upper plane thereof, tapers inwardly outwardly from arcuate portions 24, 26. Typically, the frame at point 40 at the frame rearward end has a cross-sectional dimensions of one inch at points 42 $\frac{3}{4}$ inch, and at points 44, 46 of frame forward end 28 the latter dimension (0.75 inch) is gradually reduced to $\frac{3}{8}$ (0.375) inch, point 48, the latter point lying in the axis X of net 10.

Extending radially outwardly from frame planar front end 28, typically from points 44, 46, is an extension 48, the latter, in cross-sectional view as shown in FIGS. 2 and 3, having upper and lower slanting surfaces 50, 52. The surfaces taper to a radius of 1/16. Typically, in top view, extension 50 is part-circular and, inside view as shown in FIGS. 2 and 3, resembles the configuration of the scoop end of a shovel. The front end 28 of frame 12 as well as shovel-shaped extension 50 directed outwardly from front end 28, and due to the reduction in height of these area as compared to the remainder of frame 12, facilitate the scooping of solid materials as for instance, rocks and stones and like hard solids, off the swimming pool floor (not shown) into the net 10. The particular rounded and tapered shape of extension 48 prevents digging into the pool surface and/or ripping of a swimming pool lining.

Provided in the upper surface 50 of frame forward end extension 48 is a recess 54, the latter having its center line 56 aligned with the main axis X of frame 12. Recess 54 is of generally rectangular configuration and shallow in depth.

Fixed within the confines of recess 54 is a magnet 58. Magnet 58 is operative to attract metallic objects resting on the pool floor or surface. Such objects are attracted and magnetically pulled onto extension 50 and, thence, onto magnet 58, and can be manually removed from these area.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is:

1. A skim net for swimming pools, comprising:

a polygonal frame having a rear end and a front end extending in parallelism with the transverse axis of said net and having a configuration tapering forwardly outwardly in direction away from said transverse axis;

a netting stretched within the confines of said frame and extending in the plane thereof;

a handle-attachment at said rear end of said frame; and structural means formed integrally with and extending outwardly from said forward end, the outwardly extending integral structural means being outwardly tapered and having a part-circular geometry, this outwardly tapered extension enabling scooping of solid materials off the swimming pool floor onto the net, said extension having an upper surface and a lower pool floor engaging surface, said upper surface having formed therein a recess directly adjacent the frame forward end and disposed in the plane of the longitudinal axis of said frame; and magnetic means positioned within said recess and in a plane flush with said upper surface of said extension, said magnetic means being effective to magnetically attract metallic objects and remove same from the swimming pool floor.

2. The skim net of claim 1, wherein the frame forward end has a cross-sectional dimension smaller than that of the sides and said rear end of said frame.

3. The skim net of claim 2, wherein said frame forward end and said extension have centers of reduced diameter as compared to those of said sides and said rearward end of said frame.

4. The skim net of claim 3, wherein said extension includes a rearward end of planar configuration formed integrally with said frame forward end.

5. The skim net of claim 4, wherein said extension (further comprises surface tapering) tapers from its planar rearward end outwardly to a predetermined radius.

6. The skim net of claim 5, wherein the upper tapered surface of said extension formed with said recess has a center coinciding with the longitudinal axis of said frame, said magnet being fixed in said recess, the latter having a center co-planar with that of said extension.

7. The skim net of claim 6, wherein said extension and said frame forward end together resemble a shovel-shaped structure.

8. The skim net of claim 1, wherein said frame is made of a lightweight, plastic material.

9. The skim net of claim 1, wherein said recess is of substantially rectangular configuration and has a shallow geometry, said magnetic means being in the form of a permanent magnet having an overall form and dimension closely corresponding to that of said recess.

10. A skim net for swimming pools, comprising:

a frame of substantially elliptical configuration having a rearward end and a forward end greater in length and smaller in cross-sectional dimension than said rearward end, the former end being planar in configuration and tapering outwardly;

a handle-attachment at said rearward end;

an extension formed integrally with the outwardly tapering forward end and tapered to a predetermined radius and having a peripheral rounded configuration of substantially semi-circular geometry, said extension having upper and lower surfaces, the lower surface being adapted to engage the swimming pool floor during skimming of the pool;

a substantially rectangular shallow recess formed in the tapered upper surface directly adjacent said forward end and having its center disposed in the plane of the longitudinal axis of said frame; and a permanent magnet fixedly secured within said recess and effective to attract metallic objects from the swimming pool floor, said frame forward end enabling solid matter to be scooped onto said net.

* * * * *